US005443007A

United States Patent [19]

Buenz

[11] Patent Number: 5,443,007

[45] Date of Patent: Aug. 22, 1995

[54] PRINTING MACHINE WITH INTEGRATED TEMPERATURE CONTROL SYSTEM

[75] Inventor: Robert J. Buenz, Winfield, Ill.

[73] Assignee: Tri Service, Inc., Melrose Park, Ill.

[21] Appl. No.: 226,064

[22] Filed: Apr. 11, 1994

[51] Int. Cl.[6] ..... B41F 1/34

[52] U.S. Cl. ..... 101/480; 101/479

[58] Field of Search ..... 101/487, 488, 349, 350, 101/479, 216, 480; 165/89, 90, 91

[56] References Cited

U.S. PATENT DOCUMENTS

| | | | |
|---|---|---|---|
| 5,074,213 | 12/1991 | Kurosawa | 101/487 |
| 5,177,975 | 1/1993 | Mertens | 101/487 |
| 5,189,960 | 3/1993 | Valentini et al. | 101/487 |
| 5,272,971 | 12/1993 | Fredericks | 101/350 |

OTHER PUBLICATIONS

Brochure entitled "Toray Waterless Plate" (1993).
Brochure entitled "Printing with Toray Waterless Plate" (undated).
Brochure entitled "Tri Service can help you . . . turn off the water, turn on waterless offset production." (1991).
Brochure entitled "How the Tri Service MultiZone TM Temperature Control System works." (1993).
Brochure entitled "Tri Service chillers take the heat off your press for waterless operation, and keep it out of the pressroom." (undated).
Brochure entitled "MultiZone Control maintains proper temperature at each printing unit individually." (undated).
Brochure entitled "Infrared sensors monitor temperature of every printing unit." (undated).
Brochure entitled "Conventional to waterless on factory equipped presses." (undated).
Brochure entitled "Quick retrofit for any conventional sheetfed press" (undated).

*Primary Examiner*—Ren Yan
*Attorney, Agent, or Firm*—John R. Hoffman

[57] ABSTRACT

A temperature control system for a printing press or similar machine which includes an ink distribution roller for distributing ink to a printing couple. The machine includes a frame with a control zone for accommodating various control elements of the apparatus, with an opening in the frame for access to the control elements. A control system housing is pivotally mounted on the frame for movement between a first position closing the opening in the frame and a second position exposing the opening for access to both the control elements within the frame and various control components within the housing, such as a water pump, a water heater, valves and conduits within the housing for feeding controlled temperature water to the printing couple.

21 Claims, 3 Drawing Sheets

PRINTING MACHINE WITH INTEGRATED TEMPERATURE CONTROL SYSTEM

FIELD OF THE INVENTION

This invention generally relates to the art of printing or duplicating machines and, particularly, to a system for controlling the temperature in the printing couple of the machine and, further, to the incorporation of the control system as an integrated part of the machine.

BACKGROUND OF THE INVENTION

Printing machines normally include a printing couple which has a number of cylinders and/or rollers such as impression cylinders, master or plate cylinders, blanket cylinders, ductor rollers, transfer rollers, oscillating rollers, form rollers, and the like. For instance, an ink fountain is disposed generally at the rear of the machine for feeding ink to the various rollers of the printing couple which transfers images to copy sheets. In such printing machines as rotary offset lithographic duplicating machines, a moisture fountain also is disposed adjacent the printing couple for feeding moisture to the printing couple. A number of rollers which generally can be termed "distribution" rollers are provided between the ink fountain and/or moisture fountain for distributing ink and/or moisture to the printing couple of the machine. The distribution rollers conventionally are mounted between spaced side frame plates of the machine framework.

One of the problems with ink feeding systems in machines of the character described above is the inability to effectively compensate for varying environmental conditions, such as varying temperature and/or humidity. It has been found that moisture content or "presence" in the immediate environment of a printing or duplicating machine may be the biggest problem area in maintaining quality printing. For instance, too much moisture in an inking system can "flood" the ink and cause emulsification. Even a 0.5–1.0 percent change in humidity can have a significant change in the ink flow characteristics of the machine. Consequently, an operator is constantly adjusting the ink fountain and/or moisture fountain of the machine in varying environmental conditions, because controlling the environmental humidity is very difficult if not impossible in a particular location. Yet, moisture control cannot be divorced from temperature control within the printing couple.

The moisture problem, above, in conjunction with the need for ink/water balance in conventional offset lithography has traditionally been the source of a multitude of problems for the offset printer. Variations in ink/water balance can cause emulsification of ink, as stated above, and can also lead to inconsistency in color, longer drying times, streaking problems as well as scumming and plugging of halftones.

An offset press operator must have a wide range of skills indeed to control all the complexities of offset lithography. Mechanical skill is required to understand and operate the functions of paper feed and delivery as well as register controls. Some artistic ability is necessary to interpret, match and maintain color. In addition, it also is necessary to have a basic understanding of chemistry in order to be able to understand and interpret the variables of ink/water balance. These variables include such things as water hardness, PH, conductivity, alcohol content, water take-up of ink and absorption of substrates.

Because of the various problems identified above, there is a definite contemporaneous trend to "waterless" printing processes or machines which eliminate the need for water in the printing process. By eliminating the need for ink/water balance, the waterless system changes the printing process from a chemical/physical process to a purely physical one, eliminating a large percentage of process variables as described above. The waterless system offers a shorter learning curve for press operators and greater ease of operation. Because there is no need to achieve ink/water balance at the start of a press run, a waterless press can roll up to color almost immediately. The system will normally achieve color in less than twenty impressions, thus giving the press operator nearly instant color communication. Response times to color changes are dramatically improved over conventional lithography.

Virtually any sheetfed press can be equipped to do waterless printing. Waterless plates are required. Waterless inks are required. And a control system to maintain the proper temperature is required for the waterless printing process. The control system normally includes a water circulation system through one or more points of the printing couple such as the plate cylinder or the ink "ball" or roller of the printing couple. A popular water circulation system circulates the water through one or more of the ink distribution rollers of the machine, such as an oscillating or vibrator roller. The system also includes water heater and chiller units, pumps, valving and appropriate conduits or piping. A temperature monitoring system is incorporated in the printing couple, such as at the plate cylinder surface, and a feedback system is provided to control the plate cylinder surface temperature by adjusting either water temperature or water flow to the vibrator roller(s). The bulk of the water circulation system, such as the water heater and chiller units, pumps, valving and the like normally are housed remote from the printing machine itself. Because of the remoteness of the control unit, pressure losses occur and which must be compensated for by the size of the water pump and piping. Thermal losses occur which must be compensated for in designing the size of the chiller/heater. There also is a control time leg which must be taken in consideration. Other problems include potential water leakage because of the piping and fittings required between the remote control unit and the printing machine. All of these problems are magnified in a zone control system wherein a plurality of printing machines or a plurality of printing couples within a large press, for instance, are controlled from a single control unit which is considerably remote from the machines themselves.

In many applications, it would be highly desirable to be able to integrate the various components of the temperature control system directly into the printing machine. However, in most machines there simply is insufficient room or inadequate space for the components. Even if some space is available, the space would require the components of the control system (heater, pumps, etc.) to be mounted in a high density manner which would make servicing of the control system extremely difficult if at all possible.

The present invention is directed to solving this myriad of problems by providing a unique system for mounting a temperature control system directly onto the printing machine as an integral part thereof, while allowing easy access to the components of the system, even easier access than is afforded by remote control units presently being used.

SUMMARY OF THE INVENTION

An object, therefore, of the invention is to provide a new and improved temperature control system of the character described, with the system being integrated directly in a printing machine.

In the exemplary embodiment of the invention, although the control system of the invention can be integrated in a variety of types of printing machines, the invention is shown for use in a waterless printing press such as an offset duplicating machine or similar apparatus. The machine includes an ink system having a plurality of distribution rollers for distributing ink to at least one printing couple of the machine. One or more of the distribution rollers, such as an oscillating or vibrator roller, receives circulating water therethrough for controlling the temperature of the roller and, thereby, the temperature through the printing couple. The machine further includes a frame having a control zone for accommodating various control elements of the machine. An opening in the frame, such as at the side of the machine, provides access to the control elements from exteriorly of the frame.

The invention contemplates that the temperature control system include a housing for mounting on the frame. Circulating water temperature control components are mounted within the housing and include at least a water pump, a water heater, valve means and conduit means for feeding controlled temperature water to the printing couple. Mounting means are provided for mounting the housing on the frame for movement between a first position closing the opening in the frame and a second position exposing the opening for access to both the control elements within the frame and the control components within the housing.

In the preferred embodiment of the invention as disclosed herein, the mounting means is a hinge means for providing pivotal movement of the housing between its two positions. The housing has an opening for access to the control components therewithin. The opening in the housing faces the opening in the frame when the housing is in its first or closed position. A door is hingedly mounted on the housing for closing the opening therein.

Another feature of the invention is that the housing has major height and width dimensions but minor depth dimensions so that the housing has a thin profile in a horizontal direction. The control components are located within the housing in a generally vertical planar array for easy access thereto. Therefore, the components of the control system, in fact, are easier to service than the remote console-type control units presently available.

By integrating the control system directly on the printing machine, pressure losses are decreased, thermal losses are decreased, control time lags are decreased and the potential for water leakage also is decreased. In addition, installation of the system is simplified, and the system lends itself to modular design concepts.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
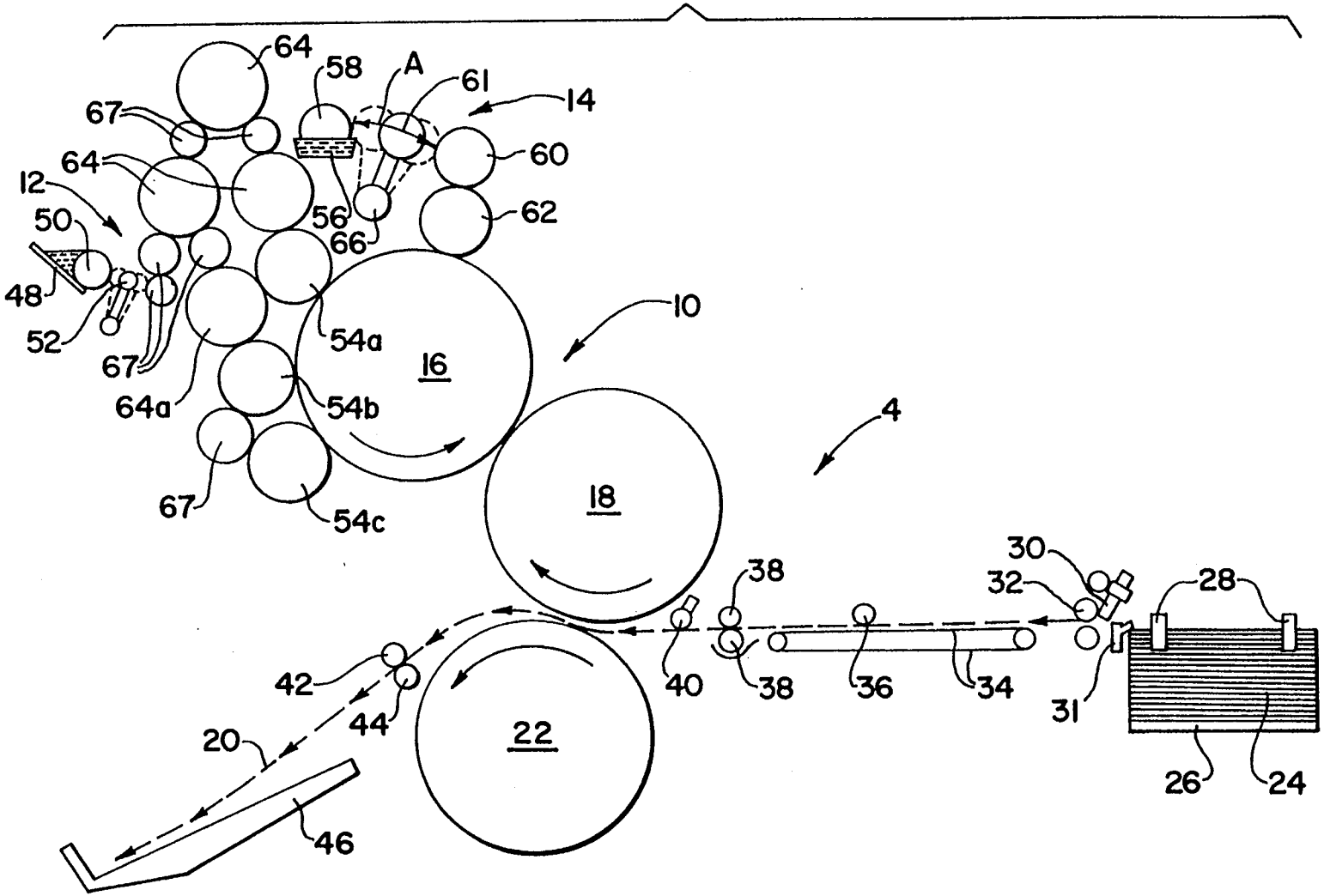
Fig. 1 PRIOR ART
FIG. 1 is a schematic illustration of the major components of a printing or duplicating machine of a type in which the invention is applicable.

Referring to the drawings in greater detail, and first to FIG. 1, the invention is applicable for use in a printing, duplicating or like machine, generally designated 4. The machine may be such as a rotary offset lithographic machine which includes an ink fountain for feeding ink to various distribution rollers of a printing couple, generally designated 10, which transfers images to copy sheets. FIG. 1 shows a conventional machine, and, therefore, a moisture fountain also is disposed adjacent the printing couple for feeding moisture to the printing couple through a path defined by the distribution rollers.

More particularly, the machine includes an ink system, generally designated 12, and a moisture system, generally designated 14, for feeding ink and moisture, respectively, to a master or plate cylinder 16 to which a master or plate is clamped. An image from the plate is transferred to a blanket cylinder 18, through surface transfer. The blanket cylinder transfers the image to a copy sheet which follows a paper path through the machine as indicated by dotted-arrow line 20 which passes between blanket cylinder 18 and an impression cylinder 22.

Generally, paper sheets are stacked, as at 24, in a paper elevator 26. Air blowers 28, vacuum feet 30, a paper corner separator 31 and pull-out wheels 32 feed the sheets seriatim to a sheet transport conveyor 34 above which are mounted skid wheels 36. From conveyor 34, the sheets are fed seriatim by feed rollers 38 beneath a paper guide assembly 40 and between blanket cylinder 18 and impression cylinder 22, as described above. After images are transferred to the copy sheets, a paper ejector wheel 42 and a paper ejector roller 44 feed the sheets to a discharge station, generally designated 46.

Ink system 12 will be described generally and briefly, and includes an ink fountain 48 having a fountain roller 50. A ductor roller 52 feeds the ink from fountain roller 50 to a number of transfer rollers, regulator rollers, oscillating rollers and, ultimately, to three ink form rollers 54*a*, 54*b* and 54*c* which transfer the ink to a plate on plate cylinder 16 by surface contact. It should be understood that the roller configuration of this ink system 12 is representative, only, and a variety of roller configurations are applicable with the invention.

Moisture system 14 includes a moisture fountain trough 56 and a fountain roller 58. Moisture is transferred from fountain roller 58 to a distribution roller 60 by a ductor roller 61 which reciprocates back and forth in the direction of double-headed arrow "A", about pivot 66, between fountain roller 58 and distribution roller 60. The construction and operation of the ductor roller is well known in the art. Moisture then is transferred, through continuous surface contact from distribution roller 60 to a form roller 62 which, in turn, transfers the moisture to the plate on plate cylinder 16, again through surface contact.

As stated above, ink system 12 includes a number of transfer rollers, regulator rollers, oscillating rollers and ink form rollers, including rollers 54*a*–54*c*. All of these rollers commonly are called "distribution" rollers for distributing ink from fountain 48 to printing couple 10, particularly to the master on master cylinder 16. Included in the ink train of distribution rollers are a plurality of oscillating or vibrator rollers 64 and a plurality of transfer rollers 67. For purposes to be described hereinafter, one of the oscillating rollers is identified by the reference numeral 64*a*.

Generally, the temperature control system of the invention includes providing one of the distribution rollers, such as oscillating roller 64*a*, as a substantially hollow roller for circulating water in a heat exchange relationship therethrough.

Figure 2:
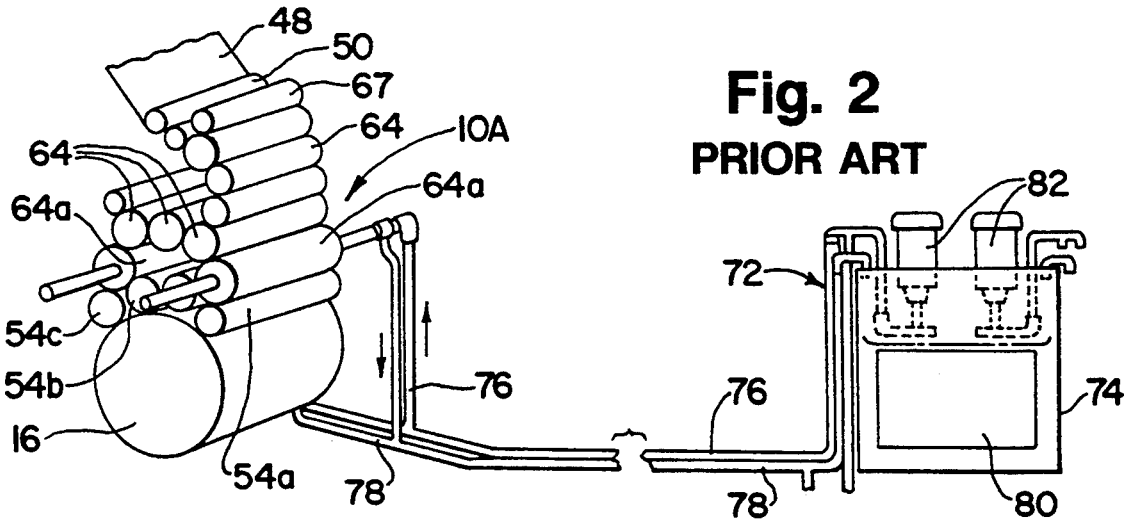
Fig. 2 PRIOR ART
FIG. 2 is a schematic illustration of the prior art incorporating a remote control system for a waterless printing couple.

FIG. 2 shows a printing couple, generally designated 10A, which may or may not have the same roller configuration as printing couple 10 in FIG. 1. Therefore, like numerals are applied in FIG. 2 corresponding to the same type of rollers described above in relation to FIG. 1. Printing couple 10A is of a type that would be used in a waterless printing machine or process and, consequently, it can be seen that the moisture system 14 of printing couple 10 in FIG. 1 has been eliminated in printing couple 10A in FIG. 2. Printing couple 10A includes two oscillating or vibrator rollers 64*a* which are substantially hollow for circulating water in a heat exchange relationship therethrough.

Still referring to FIG. 2, a temperature control system, generally designated 72, is shown as it is used predominantly in the prior art. In other words, the system is separate and remote from the printing machine, itself, and includes a console or cabinet 74 housing the major components of the system. The console may even be in a separate room from the printing machine. Water circulation pipes 76 lead to the system to rollers 64*a* and water circulating pipes 78 lead from the rollers back to the system. The system includes a water heater and chiller unit 80, along with pumps 82 and appropriate valves and other piping as is known in the waterless printing art. What is significant to note from the prior art arrangement of FIG. 2, is that all of the major components of temperature control system 72, including the heaters, pumps, etc. are located in a housing 74 which is completely separate and remote from the printing machine which includes printing couple 10A.

Figure 4:
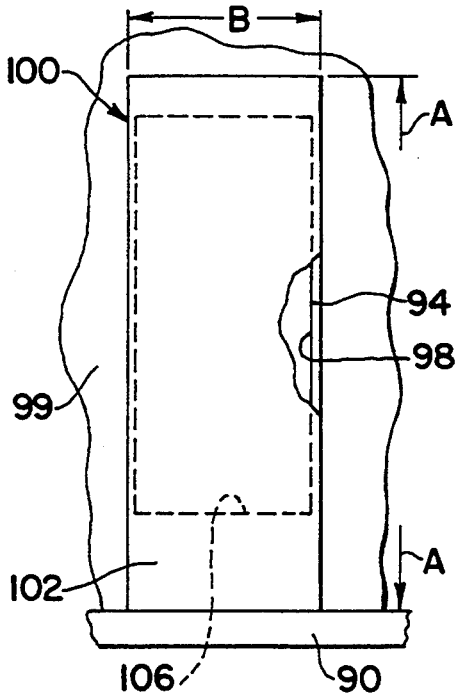
FIG. 4 is a front elevational view of the control system in its closed position.
Figure 3:
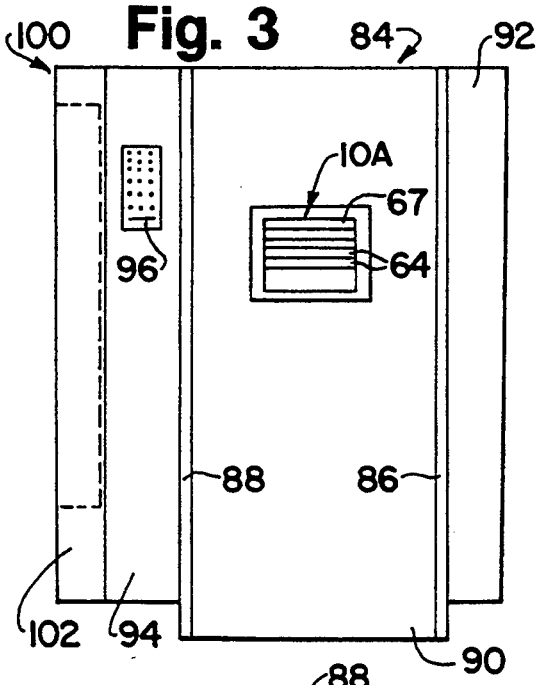
FIG. 3 is a somewhat schematic illustration of one end of a printing machine, with the control system of the invention mounted on the side thereof.

FIG. 3 shows a somewhat schematic illustration of a type of framework for a printing machine, generally designated 84. Although not to proper scale, printing coupled 10A is shown within machine 84 between a pair of side frames 86 and 88 which extend downwardly to define a supporting base 90. Of course, all of the other components of machine 4 (FIG. 1) except for the moisture system, would be located within the machine between side frames 86 and 88. A rear frame housing 92 is considered the "gear side" of the machine and houses many of the appropriate gears and other elements of the drive train and power components to operate printing couple 10A in synchronization with the sheet feeding mechanisms, etc. A front frame housing 94 mounts the various control elements of the machine and includes a control panel 96. The control elements within front frame housing 94 would include such elements as linkages, bearings, gears and other elements that are subject to servicing and/or replacement, all of which is known in the printing machine art. Referring to FIG. 4, front frame housing 94 includes an opening 98 for access to the control elements therewithin from exteriorly of the frame. Basically, the opening is in a front or side face 99 (FIG. 4) of the machine, and front frame housing 94 defines a control zone of the machine.

Figure 5:
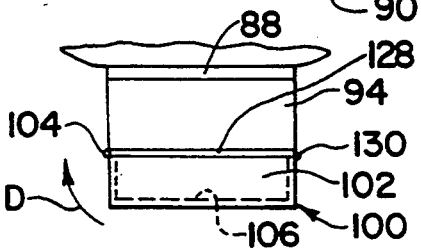
FIG. 5 is a top plan view of the control system in its closed position.

The invention contemplates the provision of a temperature control system, generally designated 100, which is integrated directly on machine 84 by mounting the control system onto front frame housing 94 closing opening 98 in the housing. Referring particularly to FIGS. 3–5, control system 100 includes a housing 102 which is generally box-shaped to define a major height dimension as indicated by arrows "A" (FIG. 4), a major width dimension as indicated by arrows "B" and a minor depth dimension as indicated by arrows "C" (FIG. 5). In other words, as seen best in FIGS. 3 and 5, housing 102 of control system 100 is a relatively thin unit in comparison to its major height and width dimensions.

Figure 7:
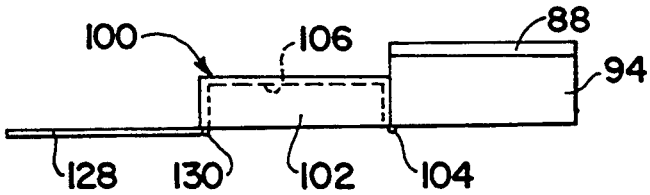
FIG. 7 is a top plan view of the control system in its open position.
Figure 6:
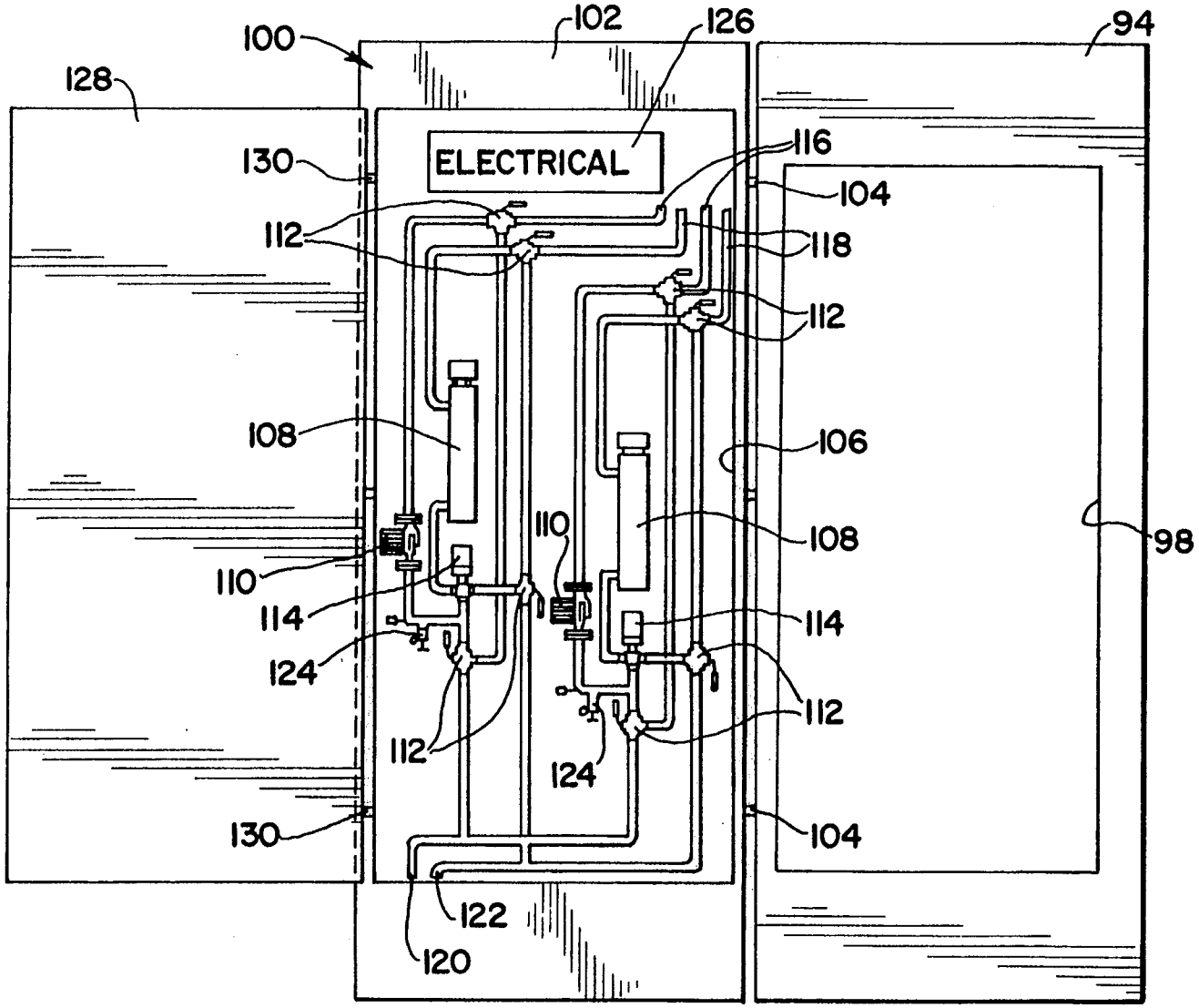
FIG. 6 is a front elevational view of the control system in its open position.

Generally, mounting means are provided for mounting housing 102 of control system 100 on the frame of machine 84 (e.g. front frame housing 94) for movement between a first position shown in FIGS. 3–5 closing opening 98 in front frame housing 94, and a second position shown in FIGS. 6 and 7 exposing the opening for access to the control elements within the front frame housing. In the preferred embodiment of the invention, the mounting means for housing 102 is provided by a hinge means 104 so that housing 102 pivots in the direction of arrow "D" (FIG. 5) from its closed position to its open position shown in FIG. 7.

Housing 102 of control system 100 defines an interior cavity 106 which is open at the rear of the housing when in its closed position as shown in FIGS. 3–5, or which is open in a forwardly facing direction in its open position as shown in FIGS. 6 and 7. Housing 102 mounts within cavity 106 the major circulating water temperature control components such as a pair of water heaters 108 and a pair of water pumps 110. A plurality of manual 3-way valves 112 and a pair of motorized 3-way valves 114 are provided in the piping of the system interconnecting heaters 108 and pumps 110. The piping include pipes 116 which correspond to pipes 76 in FIG. 2 which lead to the printing couple, as well as pipes 118 which correspond to pipes 78 in FIG. 2 which lead back from the printing couple. Flexible couplings (not shown) are connected to pipes 116 and 118 to accommodate pivotal movement of housing 102. Pipe 120 is a main chilled water supply pipe, and pipe 122 is a main water return pipe. Pipes 120 and 122 lead from and back to a water chiller (not shown). Manual drains 124 also are provided in the piping network. Basically, it can be seen in FIG. 6 that two circulation circuits, including two heaters and two pumps, are provided within control system housing 102. The two circuits may control the upper and lower printing couples of a web press, for instance. Or, the two independent circuits may be operatively associated with the two oscillating or vibrator rollers 64*a* in printing couple 10A. Lastly, an electrical box 126 is provided within control system housing 102 with appropriate control leads (not shown) to the heaters, pumps, motorized valves, etc. of the system.

As seen in FIG. 7, a door 128 is hinged, as at 130, to control system housing 102 to close the opening to cavity 106 within which all of the components described above in relation to FIG. 6, are mounted.

Referring back to FIG. 6, it can be seen that all of the major control components mounted within cavity 106 of control system housing 102 are located in a generally planar array. In other words, except for various of the pipes, each individual major control component is readily accessible and serviceable when the control system housing 102 is pivoted to its open position shown in FIGS. 6 and 7, and door 128 is open. This convenient array of the control components would be utterly impossible if integrated within the framework of printing machine 84, itself. There simply is not sufficient space available within the machine framework for all of these control components. In addition, an operator practically would have to kneel or lay down on the floor to gain access to such control components if they were mounted within the machine, such as below all of the paper handling mechanisms and apparatus described above in relation to FIG. 1.

In addition, by integrating the temperature control system 100 in the machine, itself, the pressure losses between the machine and conventional remote control units of the prior art is significantly less. This enables the control system of the invention to use smaller pumps 110 and smaller diameter piping throughout the unit. Similarly, the thermal loss between a remote control unit and the printing machine is considerably reduced by the integrated unit of the invention, which enables the use of smaller heaters 108. The control time lag between conventional remote units and the printing machine also is reduced, which improves the temperature control accuracy. The number of pipe fittings and the like is reduced by the invention to lessen the likelihood of water leakage. Such a system as disclosed herein also enables modular design concepts to be incorporated in the printing machine art. Lastly, by mounting control system housing 102 over opening 98 in front frame housing 94, an operator simply pivots control system housing 102 to its open position as shown in FIG. 6, and access is available to both the control elements of the machine and the control components of the temperature control system, even as an operator stands in a single spot.

Lastly, as stated in the "Summary", above, the temperature control system of the invention can be integrated in a variety of types of printing machines. The invention is shown herein as circulating water through pipes 76 and 78 (or 116 and 118) which lead to and from vibrator rollers 64*a* of the printing couple. However, the system could circulate water to other points of the couple, such as the plate cylinder, the ink "ball" or roller, or the like. In addition, the system of the invention is applicable for use in types of printing machines other than the waterless machine shown.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a printing press such as an offset duplicating machine and similar apparatus which includes an ink system having a plurality of distribution rollers for distributing ink to at least one printing couple of the apparatus, the apparatus including a frame with a control zone for accommodating various control elements of the apparatus with an opening in the frame for access to the control elements from exteriorly of the frame, a temperature control system comprising:

a housing;

circulating water temperature control components within the housing and including at least a water pump, a water heater, valve means and conduit means for feeding controlled temperature water to said printing couple; and mounting means for mounting the housing on said frame for movement between a first position closing said opening and a second position exposing the opening for access to both the control elements within the frame and the control components within the housing.

2. The control system of claim 1 wherein said mounting means comprise hinge means for providing pivotal movement of the housing between said first and second positions.

3. The control system of claim 1 wherein said housing has an opening for access to the control components therewithin, the opening in the housing facing the opening in the frame when the housing is in said first position.

4. The control system of claim 3, including a door movably mounted on the housing for closing the opening therein.

5. The control system of claim 4, including hinge means movably mounting the door on the housing.

6. The control system of claim 1 wherein said housing has major height and width dimensions and minor depth dimensions so that the housing has a thin profile in a horizontal direction.

7. The control system of claim 6 wherein said control components are located within the housing in a generally vertical planar array for easy access thereto.

8. A temperature control system for a printing press such as an offset duplicating machine and similar apparatus, comprising:

a printing press including a machine frame mounting at least one printing couple therewithin, the frame defining an exterior face of the machine;

an ink system mounted within the frame and having a plurality of distribution rollers for distributing ink to at least one printing couple of the machine and including an ink distribution roller that receives circulating water therethrough for controlling the temperature of the roller and, thereby, the temperature of the ink thereon and the ink flow through the printing couple;

a control zone behind said face of the frame for accommodating various control elements of the machine, and an opening in the face for access to the control zone and the control elements therewithin from exteriorly of the frame;

a control system housing mounted on the face of the frame substantially covering said opening therein;

circulating water temperature control components within the control system housing and including at least a water pump, a water heater, valve means and conduit means for feeding controlled temperature water to said ink distribution roller; and mounting means for mounting the control system housing on the frame for movement between a first position closing said opening in the face of the frame and a second position exposing the opening for access to both the control elements within the control zone of the frame and the control components within the control system housing.

9. The control system of claim 8 wherein said mounting means comprise hinge means for providing pivotal movement of the housing between said first and second positions.

10. The control system of claim 8 wherein said housing has an opening for access to the control components therewithin, the opening in the housing facing the opening in the frame when the housing is in said first position.

11. The control system of claim 10, including a door movably mounted on the housing for closing the opening therein.

12. The control system of claim 11, including hinge means movably mounting the door on the housing.

13. The control system of claim 8 wherein said housing has major height and width dimensions and minor depth dimensions so that the housing has a thin profile in a horizontal direction.

14. The control system of claim 13 wherein said control components are located within the housing in a generally vertical planar array for easy access thereto.

15. In a printing press such as an offset duplicating machine and similar apparatus which includes a frame mounting an ink system therewithin, the ink system including a plurality of distribution rollers for distributing in to at least one printing couple of the apparatus, a temperature control system comprising:

a housing;

circulating water temperature control components within the housing and including at least a water pump, a water heater, valve means and conduit means for feeding controlled temperature water to said printing couple; and mounting means for mounting the housing on said frame for movement between a first position adjacent the frame in which access to the control components within the housing is blocked and a second position providing access to the control components within the housing.

16. The control system of claim 15 wherein said mounting means comprise hinge means for providing pivotal movement of the housing between said first and second positions.

17. The control system of claim 15 wherein said housing has an opening for access to the control components therewithin, the opening in the housing facing the frame when the housing is in said first position.

18. The control system of claim 17, including a door movably mounted on the housing for closing the opening therein.

19. The control system of claim 18, including hinge means movably mounting the door on the housing.

20. The control system of claim 15 wherein said housing has major height and width dimensions and minor depth dimensions so that the housing has a thin profile in a horizontal direction.

21. The control system of claim 20 wherein said control components are located within the housing in a generally vertical planar array for easy access thereto.

* * * * *